US006948345B1

(12) United States Patent
Ruan

(10) Patent No.: US 6,948,345 B1
(45) Date of Patent: Sep. 27, 2005

(54) LOCK ENHANCEMENT ARRANGEMENT

(75) Inventor: JiaQiang Ruan, Kowloon (HK)

(73) Assignee: Path Line (NG'S) Holdings Limited, Kowloon (HK)

( * ) Notice: Subject to any disclaimer, the term of this patent is extended or adjusted under 35 U.S.C. 154(b) by 0 days.

(21) Appl. No.: 10/855,665

(22) Filed: May 26, 2004

(51) Int. Cl.[7] ..... E05B 9/08
(52) U.S. Cl. ..... 70/370; 70/373; 70/367; 70/416
(58) Field of Search ..... 70/367, 370–375, 70/416, 417

(56) References Cited

U.S. PATENT DOCUMENTS

| | | | | | |
|---|---|---|---|---|---|
| 1,027,777 | A | * | 5/1912 | Shaw | 70/373 |
| 1,575,092 | A | * | 3/1926 | Best | 70/373 |
| 2,837,908 | A | * | 6/1958 | Segal | 70/367 |
| 2,877,638 | A | * | 3/1959 | Muttart | 70/224 |
| 3,197,985 | A | * | 8/1965 | Cosio | 70/419 |
| 3,209,568 | A | * | 10/1965 | Patriquin | 70/373 |
| 3,882,703 | A | * | 5/1975 | Hermann | 70/419 |
| 4,143,531 | A | * | 3/1979 | Floyd | 70/367 |
| 4,424,693 | A | * | 1/1984 | Best et al. | 70/369 |
| 4,489,576 | A | * | 12/1984 | Mullich et al. | 70/134 |
| 4,715,201 | A | * | 12/1987 | Craig | 70/369 |
| 4,843,852 | A | * | 7/1989 | Foshee et al. | 70/367 |
| 4,899,563 | A | * | 2/1990 | Martin | 70/367 |
| 5,233,851 | A | * | 8/1993 | Florian | 70/367 |
| 5,572,890 | A | * | 11/1996 | Carpenter | 70/371 |
| 5,884,512 | A | * | 3/1999 | Wayne | 70/370 |
| 2002/0144527 | A1 | * | 10/2002 | Daising et al. | 70/373 |

* cited by examiner

*Primary Examiner*—Suzanne Dino Barrett
(74) *Attorney, Agent, or Firm*—Raymond Y. Chan; David and Raymond

(57) ABSTRACT

A lock enhancement arrangement for protecting a cylinder lock, from being damaged by an axial tension is disclosed. The lock enhancement arrangement comprises a lock body having a lock channel defining an axial lock cavity and an axial reinforcing cavity, a lock unit which is adapted for actuating a latch assembly, comprising a lock cylinder disposed in the lock cavity for a corresponding key to actuate the latch assembly and a pin seat radially extended from the lock cylinder at a position within the reinforcing cavity, and a retention member, having an axial retaining slot, securely supported within the reinforcing cavity, wherein the pin seat of the lock unit is substantially engaged with the retaining slot of the retention member to block an axial movement of the lock cylinder within the lock cavity so as to substantially retain the lock unit within the lock channel of the lock body.

13 Claims, 7 Drawing Sheets

LOCK ENHANCEMENT ARRANGEMENT

BACKGROUND OF THE PRESENT INVENTION

1. Field of Invention

The present invention relates to a lock assembly, and more particularly to a lock enhancement arrangement which is dedicatedly designed to reinforce the intensity of conventional locks so as to prevent conventional locks from being damaged by an axial tension.

2. Description of Related Arts

Locks are used everywhere since they provide people with a sense of security. Generally, locks come in all shapes and sizes, with many innovative design variations. However, most locks are based on fairly similar concepts. For most of us, the most familiar lock is the standard dead-bolt lock installed on a front door. In a normal deadbolt lock, a movable bolt or latch is embedded in the door so it can be extended out the side. This bolt is lined up with a notch in the frame. When you turn the lock, the bolt extends into the notch in the frame, so the door can't move. When you retract the bolt, the door moves freely.

Obviously, a deadbolt lock's only job is to make it simple for someone with a key to move the bolt but difficult for someone without a key to move it.

Most deadbolts use a cylinder lock. A cylinder lock is a lock in which a cylinder must rotate in order to open the lock. In the cylinder lock, the key turns a cylinder, or a plug, which turns an attached cam. When the plug is turned one way, the cam pulls in on the bolt and the door can open. When the plug turns the other way, the cam releases the bolt and the spring snaps it into place so the door cannot open. This is to say that the turning cylinder slides the bolt forward and backward. Conclusively, a cylinder lock is a lock in which a cylinder must rotate in order to open the lock. The cylinder may be held in place by a variety of locking mechanisms. The most common mechanisms in modern use is the tumber lock.

Here, it is worth to mention that the cylinder lock utilizes specific engagement or disengagement between a plurality of pin-tumblers in the lock cylinder and the key's serrations correspondingly to control the locking and unlocking functions thereof.

As shown in FIG. 1, the conventional cylinder lock which is incorporated in a door usually comprises a lock unit 20 which has a key slot formed therein, a lock body 10 embedded into a door frame having a lock cavity for receiving the lock unit 20. Furthermore, the lock unit 20 is attached on a cam which is cable of driving the locking latch or bolt. So, as a result, the lock unit 20, upon being inserted with a predetermined key, is adapted to drive the locking latch to engage with a door frame. On the other hand, the lock unit 20 is also adapted to drive the locking latch to disengage with the door frame so that the door can be unlocked.

Inside a cylinder lock, there is a sort of puzzle, which only the correct key can solve. One of the most common puzzles is the pin-and-tumbler design. In this type of cylinder lock, an outer casing has a cylindrical hole in which the plug is housed. To open the lock, the plug must rotate.

The main components in the pin-and-tumbler design are a series of small pins of varying length. The pins are divided up into pairs. Each pair rests in a shaft running through the central cylinder plug and into the casing around the cylinder plug. Springs at the top of the shafts keep the pin pairs in position in the plug. When no key is inserted, the bottom pin in each pair is completely inside the plug, while the upper pin is halfway in the plug and halfway in the casing. The position of these upper pins keeps the plug from turning—the pins bind the plug to the casing.

Furthermore, the plug has a straight, shaped slot known as the keyway at one end to allow the key to enter the plug; the other end may have a cam or lever which activates a mechanism to retract a locking bolt. A series of holes, typically five or six of them, are drilled vertically into the plug. These holes contain key pins of various lengths, which are rounded to permit the key to slide over them easily. The correct key will position the pins in a pin-and-tumbler lock so that all of the lower pins rest in the cylinder plug and all of the upper pins rest in the casing. This allows the plug to rotate, thus opening the lock. When the key is not in the lock, the pins straddle the shear point, preventing the plug from rotating.

It is thus clear that the the lock unit is the by far the important part of the lock, like a heart to a human being. Its performance and safety directly determines the quality of the lock.

Unfortunately, this conventional cylinder lock has an observable drawback, which is susceptible to easy damage. Referring to the FIG. 1, the commonly used cylinder lock is illustrated. It is seen that the lock unit 20 is directly installed into a lock body 10 having a front cover A14 as shown in FIG. 1, as a result, the lock unit is directly biasing against the front cover A14. I.e. the front cover A14 is bearing most of axial thrust force from the lock unit A20. Moreover, since the outer casing of the lock unit A20 has several vertical shafts for holding the spring-loaded pins, the outer casing further comprises a crester portion A21 protudingly extended from the outer casing of lock unit A20. Actually, it is the front end A21*a* of the crester portion A21 which is directly biasing the front cover A14 of the lock body 10, so that the front end A21*a* of the crester portion 21 is capable of creating an enormous intensity of pressure on the front cover A14. However, sometimes, the front cover A14 is relatively thin and weak to withstand such a huge pressure. So the front cover A14 is susceptible to be cracked and vulnerable to be broken off thus causing the lock unit A20 be pull out from the lock body A10.

Very often, the front cover A14 is not strong enough both in terms of the materials used and its structure so that a potential intruder, by vigorously breaking the front cover A14 of the lock boy 10, can be able to pull out the lock unit 20 from the lock body 10 and destroy the door lock.

We now are living in a security aware society. The lock, as its name implies, has to play a more important role to protecting properties. It is witnessed that governments had enacted more and more rigorous standard for the tensile strength of the cylinder lock having a lock unit. For example, the United States of America issued the BHMA (Builders Hardware Manufacturers Association) categorizing an anti-twist ability and an impact resistance of a regular door lock as each having three distinct levels, namely first class (11000N), second class(4800N), and third class(2300N) respectively. Unfortunately, most conventional door locks fail to achieve the first class standard since there are no tension reinforcement structure have been applied for protecting the lock unit at all.

Because of the inherent structural features of conventional cylinder locks as mentioned above, a stronger and more secure lock is definitely required for preventing the lock unit from being pulled out from the lock body.

SUMMARY OF THE PRESENT INVENTION

A main object of the present invention is to provide a lock enhancement arrangement to a conventional cylinder lock wherein the lock enhancement arrangement is adapted for protecting the cylinder lock from being damage by an axial tension.

Another object of the present invention is to provide a lock enhancement arrangement to a conventional cylinder lock, wherein the lock enhancement arrangement comprises a retention member positioned between the lock unit and front cover of the lock body for preventing the crest portion of the lock unit from being directly contacted with the front cover of the lock body.

Another object of the present invention is to provide a lock enhancement arrangement to a conventional cylinder lock, wherein the lock body further comprises a retention cavity communicating with the lock cavity for receiving the retention member, moreover, at least one protruding ledge is defined in the retention cavity as a stopper for preventing the retention member from directly engaging with the front cover of the lock body, as a result, the cylinder lock is rather safe for resisting a potential axial tension.

Another object of the present invention is to provide a lock enhancement arrangement to a conventional cylinder lock, wherein the lock enhancement arrangement is not involved complicated or expensive mechanical components.

Another object of the present invention is to provide a lock enhancement arrangement to a conventional cylinder lock which is capable of substantially qualifying the highest standard in the field of security locks.

Accordingly, in order to accomplish the above objects, the present invention provides a lock enhancement arrangement of a lock assembly, comprising:

- a lock body having a lock channel defining an axial lock cavity and an axial reinforcing cavity communicating with the lock cavity;
- a lock unit, which is adapted for actuating a latch assembly, comprising a lock cylinder disposed in the lock cavity for a corresponding key to actuate the latch assembly and a pin seat radially extended from the lock cylinder at a position within the reinforcing cavity; and
- a retention member, having an axial retaining slot, securely supported within the reinforcing cavity, wherein the pin seat of the lock unit is substantially engaged with the retaining slot of the retention member to block an axial movement of the lock cylinder within the lock cavity so as to substantially retain the lock unit within the lock channel of the lock body.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
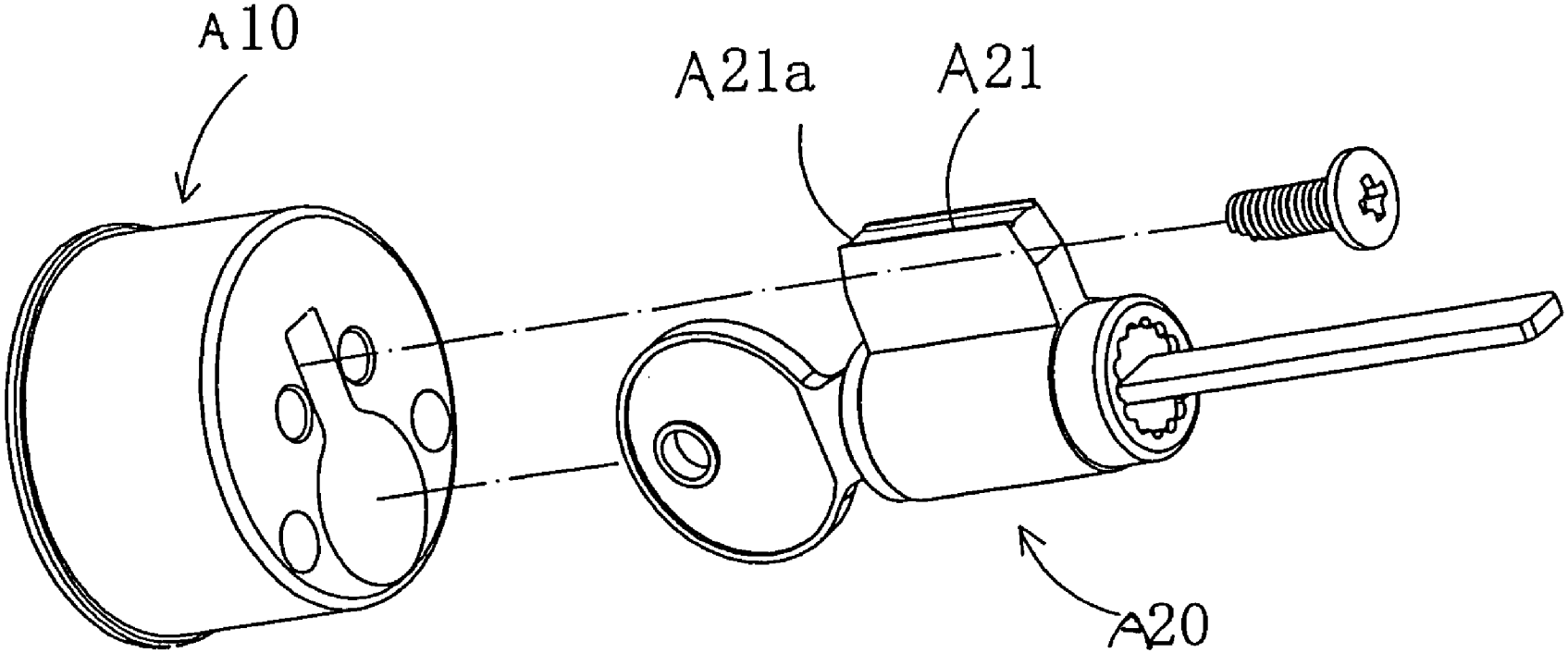
FIG. 1A is an exploded perspective view of a conventional cylinder lock.
Figure 1B:
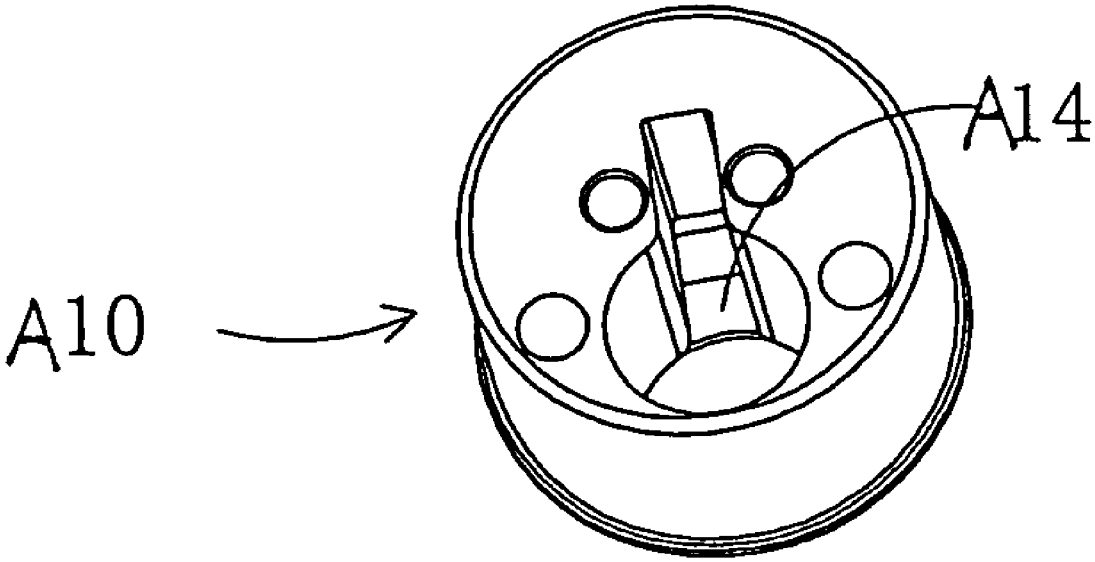
FIG. 1B is a perspective view of a conventional cylinder lock showing the lock body and its front cover.

Referring to the FIGS. 1A to 1B, the conventional cylinder lock is illustrated. The cylinder lock A1 comprises a lock body A10 having a lock cavity and a front cover A14, and a lock unit A20 received in the lock cavity A11 of the lock body A10. The lock unit A20 is directly biasing against the front cover A14. I.e. the front cover A14 is bearing most of axial thrust force from the lock unit A20. Moreover, as mentioned before, since the lock cylinder A22 of the lock unit A20 has several vertical shafts for holding the spring-loaded pins, the lock cylinder A22 further comprises a pin seat A21, just like a crest portion radially extended from the outer casing of lock unit A20. Actually, it is the front end A21*a* of the pin seat A21 which is directly biasing the front cover 14 of the lock body 10, so that the front end A21*a* is capable of creating an enormous intensity of pressure on the front cover A14. However, sometimes, the front cover A14 is relatively thin and weak to withstand such a huge pressure. So the front cover A14 is susceptible to be cracked and vulnerable to be broken off thus causing the lock unit A20 be pull out from the lock body A10.

Very often, the front cover A14 is not strong enough both in terms of the materials used and its structure so that an potential intruder, by vigorously breaking the front cover A14 of the lock boy A10, can be able to pull out the lock unit 20 from the lock body 10 and destroy the door lock.

Referring to the FIG. 2 to FIG. 5, the lock enhancement arrangement for protecting a cylinder lock from an axial tension according to the first preferred embodiment is illustrated. The lock enhancement arrangement comprises a lock body 10 having a lock channel defining an axial lock cavity 111 and an axial reinforcing cavity 112 communicating with the lock cavity 111.

The lock enhancement arrangement further comprises a lock unit 20, which is adapted for actuating a latch assembly, comprising a lock cylinder 22 disposed in the lock cavity 111 for a corresponding key to actuate the latch assembly and a pin seat 21 radially extended from the lock cylinder 22 at a position within the reinforcing cavity 112.

At the same time, the lock enhancement arrangement further comprises a retention member 30, having an axial retaining slot 32, securely supported within the reinforcing cavity 112, wherein the pin seat 21 of the lock unit 20 is substantially engaged with the retaining slot 32 of the retention member 30 to block an axial movement of the lock cylinder 22 within the lock cavity 111 so as to substantially retain the lock unit 20 within the lock channel 11 of the lock body 10.

The lock unit 20 comprises a lock cylinder acted as an outer casing for housing a plug 23, wherein the pin seat 21 is radially extended from the lock cylinder 22 for accommodating the spring-loaded pins.

As mentioned before, the lock unit 20 is the by far the most important part of a lock, like a heart to a human being. Its performance and safety directly determines the quality of the lock. In the present invention, the lock unit 20 could be applied in the most common pin-and-tumbler design of a cylinder lock assembly. The lock unit 20 comprises a lock cylinder 22 which has a cylindrical hole in which the plug 23 is housed. According the designing mechanism, the plug 23 must rotate to open the lock.

Further, the plug 23 has a straight, shaped slot known as the keyway at one end to allow the key to enter the plug 23; the other end may have a cam or lever which activates a mechanism to retract a locking bolt. At the meanwhile, a series of holes, typically five or six of them, are drilled vertically into the plug. These holes contain key pins of various lengths, which are rounded to permit the key to slide over them easily.

The main components in the pin-and-tumbler design are a series of small pins of varying length. The pins are divided up into pairs. Each pair rests in a shaft running through the plug 23 and into the lock cylinder 22 encasing around the plug 23. Accordingly, springs at the top of the shafts keep the pin pairs in position in the plug 23. When no key is inserted, the bottom pin in each pair is completely inside the plug 23, while the upper pin is halfway in the plug and halfway in the lock cylinder 22. The position of these upper pins keeps the plug 23 from turning—the pins bind the plug 23 to the lock cylinder 22.

Accordingly, to accommodate these shafts running through the plug 23 and into the lock cylinder 22, the lock unit 20 comprises not only a lock cylinder 22 for housing the plug 23, and a pin seat 21 radially extended from the lock cylinder 22 holding those shafts running through the plug 23.

Here, to offsetting an axial force caused by the pin seat 21 of the lock unit 21, the lock enhancement arrangement provides a retention member 30 positioned between the lock unit 20 from directly engaging with the front end of the lock body 10. Preferably, the retention member 30 is made of high-strength steel.

Figure 2:
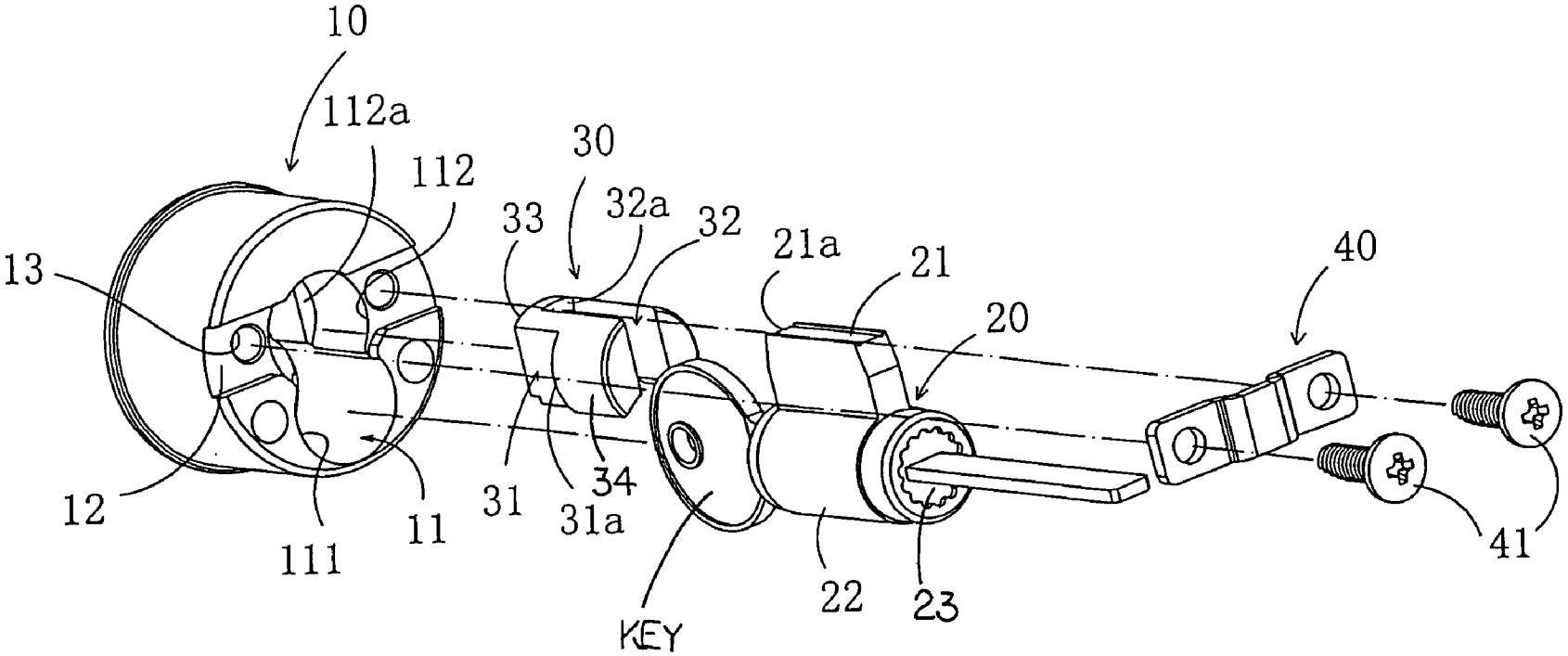
FIG. 2 is an exploded perspective of a lock enhancement arrangement to a cylinder lock according to the first preferred embodiment of the present invention.

As shown in FIG. 2 and FIG. 3, the retention member 30 has a non-circular shaped front blocking portion 31 and a circular shaped rear holding portion 34 having a size bigger than the blocking portion 31 thereof to form at least two blocking walls, the first blocking wall 33 and the second blocking wall 31*a* respectively, to engage with the reinforcing cavity 112*a*.

It is noted that the retention member 30 is a blocky shaped member having a columned body horizentially laid down for separating the pin seat 21 of lock unit 20 from directly biasing the lock body 10. In other words, the retention member 30 looks like a columned member being kept flat for blocking the pin seat 21 of the lock unit 20 away from other objects.

According to the preferred embodiment of present invention, two side portion of retention member 30 close to the front surface 33 are indentedly cut off to create two front blocking portions 31 of the retention member 30 as shown in FIG. 2 and FIG. 3. It is noted that the front blocking portion 31 automitically defines the second blocking wall 31*a* being orientated towards the front end of the lock body 10.

Moreover, the retaining slot 32 is extended from the blocking portion 31 of the retention member 30 to the holding portion 34 thereof to form a rear opening to allow the pin seat 21 fittingly sliding into the retaining slot 32 of the retention member 30 until a front end 21*a* of said pin seat is blocked by a back wall 32*a* of the retaining slot 32.

Stated in another way, the retention member 30 has a U-shaped retaining slot 32 vertically cutting through portion of the flat-kept columned body of the retention member 30 for receiving the pin seat 21 of the lock unit 20. Accoringly, the elongated U-shaped retaining slot 32 has a back wall 32*a* acted as a stopper for abstracting the advancing pin seat 21 of the lock unit 20. meanwhile, the front end 21*a* of the crest portion 21 is rearwardly curved for reducing the intensity of pressure when biasing against the back wall 32*a* of the retaining slot 32 of the retention member 30.

What is more, to achieve a tight engagement between the lock unit 20 and the retention member 30, the retention member 30 further has a curved shearing-off profile defined on the bottom of its flat-kept columned body so that the retention member 30 is capable of being snugly nested on the lock cylinder 22 of the lock unit 20. In other words, the bottom surface of the retention member 30 is inwardly curved to be tightly engaged with the circumferential shaped lock cylinder 22 of the lock unit 20. Therefore, the retention member 30 not only acts as a buffering member for blocking the pin seat 21 of the lock unit 20 directly engaging with the reinforcing cavity of the lock body, but also acts as a fixing member for preventing the lock unit 20 from being rotation.

The lock body 10 is also a columned shaped body having a lock channel 11 having an axial lock cavity 111 and an axial reinforcing cavity 112 communicating with the lock cavity 111. Preferrably, the lock body 10 is made of zinc alloy. The front cover 14 is provided on a front end of the lock body 10 for encasing the the lock body 10 except for preserving a keyway slot. In addition, there is an elongated groove 12 defined on the rear end of the lock body 10 aligned with the rear opening of the reinforcing cavity 112.

Here, the lock enhancement arrangement further comprises an elongated locking member 40 and at least a locking element 41 locking the locking member on a rear side of the lock body 10 at a position across a rear opening of the reinforcing cavity 112 so as to lock up the lock unit 20 within the lock channel 11 from behind, wherein the locking member 40 is received in the elongated groove 12 to enclose the pin seat 21 of the lock unit 20 within the reinforcing cavity 112.

The reinforcing cavity 112 has a front portion having a non-circular cross section matching with the blocking portion 31 of the retention member 30, a rear portion having a circular cross section matching with the holding portion 34 of the retention member 30, and at least two biasing walls 112*a* which are formed between the front and rear portions of the reinforcing cavity 112 and arranged in such a manner that when the retention member 30 is fitted into the reinforcing cavity 112, the blocking portion 31 and the holding portion 34 of the retention member 30 are slidably inserted into the front and rear portions of the reinforcing cavity 112 respectively until the second blocking walls 31*a* of the retention member 30 is blocked by the biasing walls 112*a* of the reinforcing cavity.

In other words, the lock body 10 further comprises a pair of protruding ledge extended integrally and inwardly extended from a predetermined position of the side wall of the reinforcing cavity 112 to form a pair of stoppers defining a pair of biasing walls 112*a* in the reinforcing cavity 112 so as to block the blocking wall 31*a* of the advancing retention member 30, thereby preventing the retention member 30 from moving towards the front end of the lock body 10.

It is worth to mention the distance from the biasing wall 112*a* to the front end of the lock body 10 is predetermined to correspondingly match the length of front blocking portion 31 of the retention member. Therefore, after the retention member 30 is inserted into the lock channel 11, the first blocking wall 33(front end of the retention member) is aligned with the front end of lock body 10 as shown in FIG. 4B.

Figure 4A:
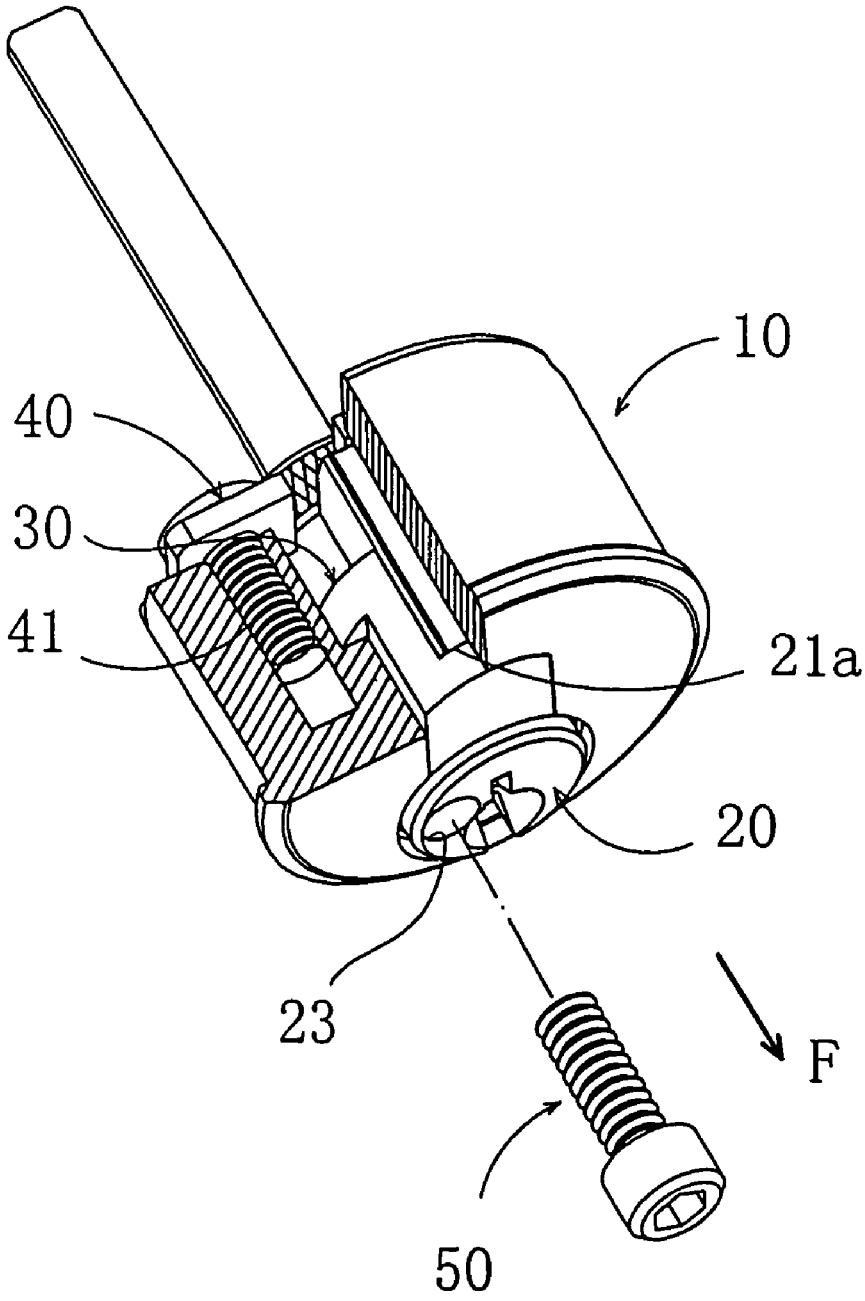
FIG. 4A is a sectional perspective view of the lock enhancement arrangement to a cylinder lock according to the first preferred embodiment of the present invention.
Figure 4B:
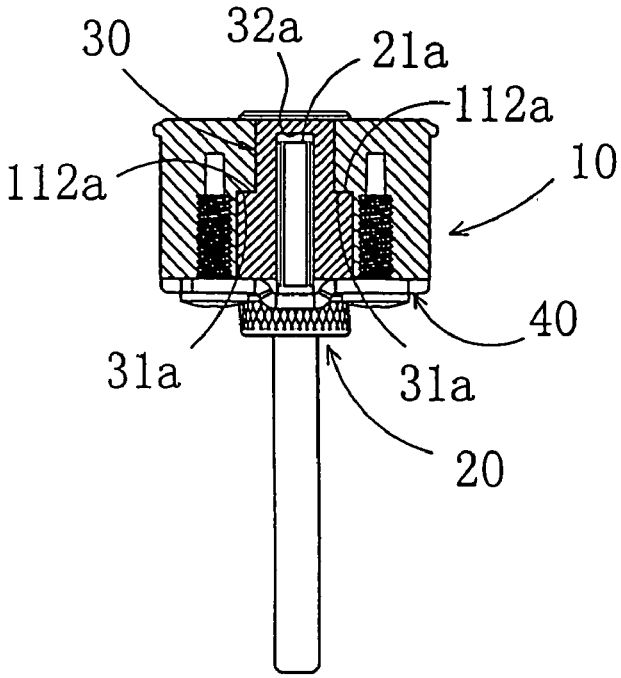
FIG. 4B is a section view of the lock enhancement arrangement to a cylinder lock according to the first preferred embodiment of the present invention.
Figure 5:
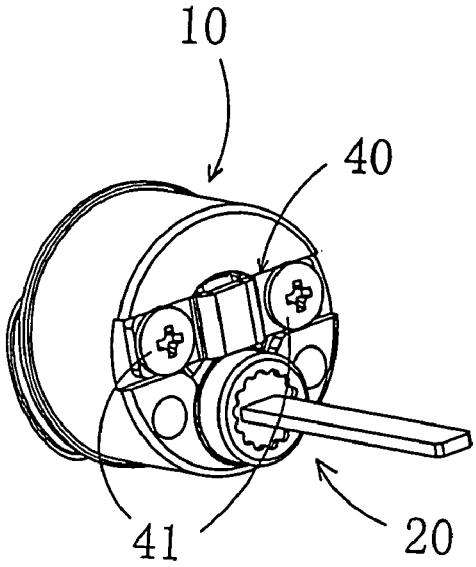
FIG. 5 is rear perspective view of the lock enhancement arrangement to a cylinder lock according to the preferred embodiment of the present invention.

Moreover, the retention member 30 also has a predetermined length corresponding to the reinforcing cavity 112 such that when the retention member is slid into the reinforcing cavity 112, the front end 33 of the retention member is aligned with a front side of said lock body as shown in FIG. 4B.

Figure 3A:
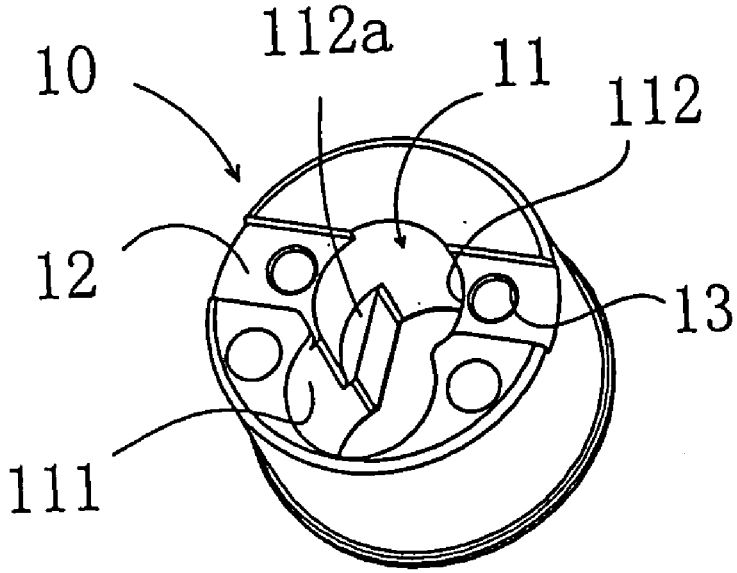
FIG. 3A is a perspective view of lock body of the lock enhancement arrangement to a cylinder lock according to the first preferred embodiment of the present invention, illustrating the protruding ledge integrally and inwardly extended from the lock body to define a stopper in the lock cavity.
Figure 3B:
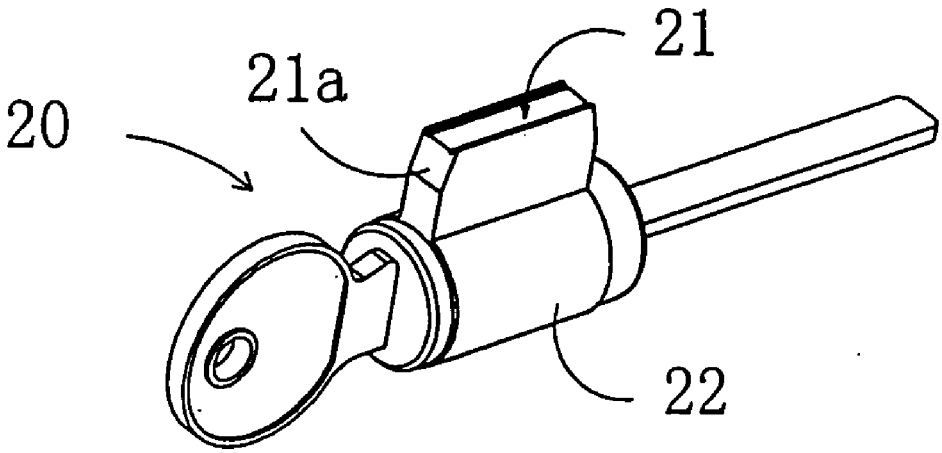
FIG. 3B is a perspective view of a lock unit of the lock enhancement arrangement to a cylinder lock according to the first preferred embodiment of the present invention, showing the front end of the crest portion is rearwardly curved for reducing the intensity of pressure when biasing against an object.
Figure 3C:
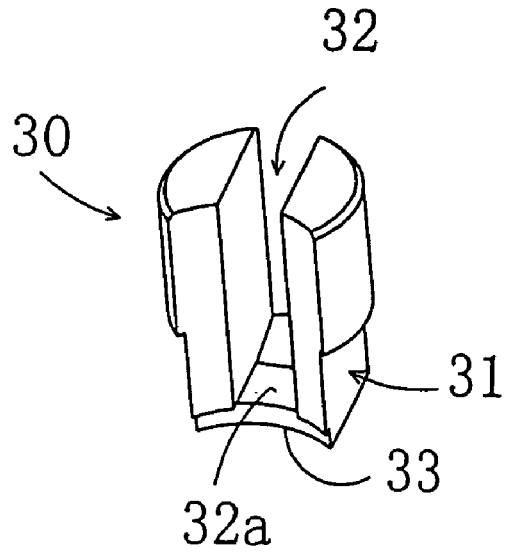
FIG. 3C is a perspective view of a retention member of the lock enhancement arrangement to a cylinder lock according to the first preferred embodiment of the present invention.
Figure 3D:
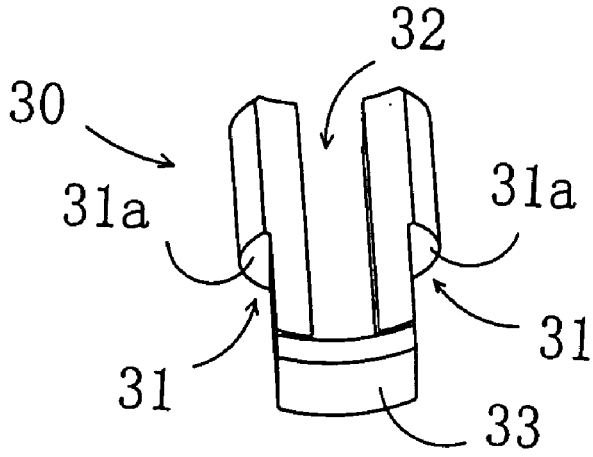
FIG. 3D is a top view of the retention member of the lock enhancement arrangement to a cylinder lock according to the first preferred embodiment of the present invention.

According to the first preferred embodiment of the present invention, the lock channel 11 is adaptive for receiving the lock unit 20 as well as the retention member 30. as shown in FIG. 2 and FIG. 3A, the lock cavity 111 is adapted for receiving the lock cylinder 22 of the lock unit 20 and the reinforcing cavity 112 is adapted for receiving the retention member 30 respectively. The lock cavity 111 is non-coaxially extended from the reinforcing cavity 112 to form the lock channel 11 having a "8" shaped cross sectional axially extended through the lock body 10. In other words, the lock cavity 111 further has an extended and enlarged portion for correspondingly receiving the retention member 30 compared with the lock cavity of conventional cylinder lock.

According to the first preferred embodiment of the present invention, the stopper for defining a biasing wall 112*a* within the reinforcing cavity 112 is a D-shaped ledge extended from the side wall of the reinforcing cavity 112 in a predetermined position closes to front end of the lock body 10. It is noted that the biasing wall 112*a* could be embodied as a flat surface or an arch surface.

As shown in FIG. 4A, after an axial force F is applied on the lock unit 20, the front end 21*a* of the pin seat 21 of the lock unit would create a biasing force against the retention member 30 thus forcing the pin seat 21 to be tightly inserted into the retaining slot 32 of the retention member 30 until the front end 21*a* of the pin seat 21 reached the back wall 32*a* of the retention member 32. As a result, the axial thrust force created by the pin seat 21 of the lock unit 20 is totally transmitted to the retention member 30 thereby pushing the retention member moving axially towards the front end of the lock body 10.

Afterwards, the protruding ledge extended from the side wall of the reinforcing cavity 112 of the lock body 10 will act as a stopper in the lock channel 11 obstructing the advancing retention member 30 from moving axially towards the front end of the lock body 10, since the stopper defines a biasing wall 112*a* for obstructing the blocking wall 31*a* provided on the retention member 30.

It is thus clear that the lock reinforcement is capable of efficiently blocking the lock unit 20 moving towards the front end of the lock body 20, and providing an intrinsic structure for assisting the lock body 10 against an axial impact force. It is tested that the cylinder lock installed with the lock enhancement arrangement of the present invention are able to comply with the first class BHMA standard. This is to say that under 11000N tension, the cylinder lock of the present invention could be used securely.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A lock enhancement arrangement of a lock assembly, comprising:

a lock body having a lock channel defining an axial lock cavity and an axial reinforcing cavity communicating with said lock cavity;

a lock unit, which is adapted for actuating a latch assembly, comprising a lock cylinder disposed in said lock cavity for a corresponding key to actuate said latch assembly and a pin seat radially extended from said lock cylinder at a position within said reinforcing cavity; and a retention member, having an axial retaining slot, securely supported within said reinforcing cavity, wherein said pin seat of said lock unit is substantially engaged with said retaining slot of said retention member to block an axial movement of said lock cylinder within said lock cavity so as to substantially retain said lock unit within said lock channel of said lock body, wherein said retention member has a non-circular shaped front blocking portion and a circular shaped rear holding portion having a size bigger than said blocking portion thereof to form at least two blocking walls to engage with said reinforcing cavity, wherein said reinforcing cavity has a front portion having a non-circular cross section matching with said blocking portion of said retention member, a rear portion having a circular cross section matching with said holding portion of said retention member, and at least two biasing walls which are formed between said front and rear portions of said reinforcing cavity and arranged in such a manner that when said retention member is fitted into said reinforcing cavity, said blocking portion and said holding portion of said retention member are slidably inserted into said front and rear portions of said reinforcing cavity respectively until said blocking walls of said retention member are blocked by said biasing walls of said reinforcing cavity respectively.

2. The lock enhancement arrangement, as recited in claim 1, wherein said front portion of said reinforcing cavity has a U-shaped cross section corresponding to said blocking portion of said retention member having a rectangular cross section.

3. A lock enhancement arrangement of a lock assembly, comprising:

a lock body having a lock channel defining an axial lock cavity and an axial reinforcing cavity communicating with said lock cavity;

a lock unit, which is adapted for actuating a latch assembly, comprising a lock cylinder disposed in said lock cavity for a corresponding key to actuate said latch assembly and a pin seat radially extended from said lock cylinder at a position within said reinforcing cavity; and a retention member, having an axial retaining slot, securely supported within said reinforcing cavity, wherein said pin seat of said lock unit is substantially engaged with said retaining slot of said retention member to block an axial movement of said lock cylinder within said lock cavity so as to substantially retain said lock unit within said lock channel of said lock body, wherein said retention member has a non-circular shaped front blocking portion and a circular shaped rear holding portion having a size bigger than said blocking portion thereof to form at least two blocking walls to engage with said reinforcing cavity, wherein said retaining slot is extended from said blocking portion of said retention member to said holding portion thereof to form a rear opening to allow said pin seat fittingly sliding into said retaining slot of said retention member until a front end of said pin seat is blocked by a back wall of said retaining slot, wherein said reinforcing cavity has a front portion having a non-circular cross section matching with said blocking portion of said retention member, a rear portion having a circular cross section matching with said holding portion of said retention member, and at least two biasing walls which are formed between said front and rear portions of said reinforcing cavity and arranged in such a manner that when said retention member is fitted into said reinforcing cavity, said blocking portion and said holding portion of said retention member are slidably inserted into said front and rear portions of said reinforcing cavity respectively until said blocking walls of said retention member are blocked by said biasing walls of said reinforcing cavity respectively.

4. The lock enhancement arrangement, as recited in claim 3, wherein said front portion of said reinforcing cavity has a U-shaped cross section corresponding to said blocking portion of said retention member having a rectangular cross section.

5. The lock enhancement arrangement, as recited in claim 3, wherein said lock cavity is non-coaxially extended from said reinforcing cavity to form said lock channel having a "8" shaped cross sectional axially extended through said lock body.

6. The lock enhancement arrangement, as recited in claim 4, wherein said lock cavity is non-coaxially extended from said reinforcing cavity to form said lock channel having a "8" shaped cross sectional axially extended through said lock body.

7. The lock enhancement arrangement, as recited in claim 3, wherein said retention member has a predetermined length corresponding to said reinforcing cavity such that when said retention member is slid into said reinforcing cavity, a front end of said retention member is aligned with a front side of said lock body.

8. The lock enhancement arrangement, as recited in claim 4, wherein said retention member has a predetermined length corresponding to said reinforcing cavity such that when said retention member is slid into said reinforcing cavity, a front end of said retention member is aligned with a front side of said lock body.

9. The lock enhancement arrangement, as recited in claim 6, wherein said retention member has a predetermined length corresponding to said reinforcing cavity such that when said retention member is slid into said reinforcing cavity, a front end of said retention member is aligned with a front side of said lock body.

10. The lock enhancement arrangement, as recited in claim 6, further comprising an elongated locking member and at least a locking element locking said locking member on a rear side of said lock body at a position across a rear opening of said reinforcing cavity so as to lock up said lock unit within said lock channel from behind.

11. The lock enhancement arrangement, as recited in claim 9, further comprising an elongated locking member and at least a locking element locking said locking member on a rear side of said lock body at a position across a rear opening of said reinforcing cavity so as to lock up said lock unit within said lock channel from behind.

12. The lock enhancement arrangement, as recited in claim 10, wherein said lock body has an elongated groove longitudinally formed on said rear side of said lock body aligned with said rear opening of said reinforcing cavity, wherein said locking member is received in said elongated groove to enclose said pin seat of said lock unit within said reinforcing cavity.

13. The lock enhancement arrangement, as recited in claim 11, wherein said lock body has an elongated groove longitudinally formed on said rear side of said lock body aligned with said rear opening of said reinforcing cavity, wherein said locking member is received in said elongated groove to enclose said pin seat of said lock unit within said reinforcing cavity.

* * * * *